United States Patent [19]

Neese et al.

[11] Patent Number: 4,583,677

[45] Date of Patent: Apr. 22, 1986

[54] BOX INNER PARTITION PROVIDING FOUR CELLS

[75] Inventors: Gerald W. Neese, Garden Grove; Scott M. Dever, Norwalk, both of Calif.

[73] Assignee: Purex Corporation, Lakewood, Calif.

[21] Appl. No.: 655,038

[22] Filed: Sep. 27, 1984

[51] Int. Cl.[4] ..... B65D 5/48

[52] U.S. Cl. ..... 229/15; 229/28 R; 229/42

[58] Field of Search ..... 229/15, 27, 28 R, 42; 220/416, 418; 217/23, 33; 206/583, 594

[56] References Cited

U.S. PATENT DOCUMENTS

| | | | |
|---|---|---|---|
| 1,464,182 | 8/1923 | Levigton | 229/15 |
| 1,691,533 | 11/1928 | Stevens | 229/15 |
| 2,154,085 | 4/1939 | Bergstein | 217/23 |
| 2,605,039 | 7/1952 | DeLine | 229/42 |
| 3,209,979 | 10/1965 | Ziegfeld | 229/15 |
| 3,240,417 | 3/1966 | Andreini | 220/416 |
| 3,770,184 | 11/1973 | Rockefeller | 229/42 X |
| 3,963,168 | 6/1976 | Frum | 229/28 R |
| 4,179,061 | 12/1979 | Gilbert | 229/27 |
| 4,204,630 | 5/1980 | Focke | 229/15 |
| 4,335,842 | 6/1982 | Bradford et al. | 229/15 |

FOREIGN PATENT DOCUMENTS

| | | | |
|---|---|---|---|
| 588765 | 12/1959 | Canada | 229/15 |
| 2484367 | 12/1981 | France | 229/15 |
| 13138 | 10/1901 | Sweden | 229/27 |

*Primary Examiner*—William Price
*Assistant Examiner*—Gary E. Elkins
*Attorney, Agent, or Firm*—William W. Haefliger

[57] ABSTRACT

A box inner partition provides at least four cells in the box interior formed by box opposite side walls and box opposite end walls. The partition comprises:

(a) the partition folded to form opposite end walls, opposite side walls, and a divider, thereby providing two cells between the divider and the partition opposite end walls, (b) and spacers carried by the partition and projecting endwise beyond the partition end walls to cooperate with the box end walls thereby to locate the partition in the box to define two additional cells between the partition end walls and the box end walls.

9 Claims, 3 Drawing Figures

BOX INNER PARTITION PROVIDING FOUR CELLS

BACKGROUND OF THE INVENTION

This invention relates generally to box partitions, and more particularly to a low-cost, rugged partition which is easily produced, and has multiple advantages as are described herein.

Corrugated boxes are used extensively to contain unit packages that are commonly found on grocery store shelves. It is generally accepted that additional corrugated board or fibre board inner pack dividers are needed in boxes that contain glass or plastic bottle package units. The inner packing is required to divide the bottles into cells for protection against damage due to lateral shifting or excessive localized compression.

There is a need for low-cost, rugged partitions which maintain bottle cell sizes in boxes by co-operation with such boxes to transfer bottle loading to the box walls from the partition walls.

SUMMARY OF THE INVENTION

It is a major object of the invention to provide a partition structure which meets the above need, and which also has multiple additional advantages. The invention provides a one-piece folded sheet of corrugated board that is cut and perforated so that it can be formed into a four-cell bottle divider. The design is unique, as it uses a minimum quantity (area) of board to form a rigid, stable, symetrical four cell inner partition. As such, its cost is also minimized when compared to other forms of inner-packing on the market, e.g., multi-piece assembled partitions or single sheet M-style dividers. The one-piece folded sheet can be made of any material structured for strength required. The four cell divider is not limited to bottles but can be used to separate many different package types. (cartons, bags, cans, etc.).

The invention is typically embodied in a box inner partition providing four cells in the box interior formed by box opposite side walls and box opposite end walls, the partition comprising (a) the partition folded to form opposite end walls, opposite side walls, and a divider, thereby providing two cells between the divider and the partition opposite end walls, (b) and spacers carried by the partition and projecting endwise beyond said partition end walls to cooperate with the box end walls thereby to locate the partition in the box to define two additional cells between the partition end walls and the box end walls.

As will appear, the spacers are typically cut from partition walls so that all spacers extend flatly adjacent box side walls, the spacers having terminals extending adjacent box end walls. Further, two spacers typically project in a first cell and two partitions project in a fourth cell, the folded partition defining second and third cells located sequentially between said first and fourth cells.

For added strength, the divider typically has an end which interlocks with one partition side wall, and the partition may have an opposite end on another side wall that extends adjacent a fold that interconnects said divider with yet another side wall.

The unitary partition itself typically may include six walls or panels that extend in sequence, successive walls interconnected by folds, the six walls when folded forming:

(i) the second, fourth and sixth walls extending in spaced apart parallel relation, in lateral vertical planes, the sixth wall located between the second and fourth walls, (ii) the first, third and fifth walls extending in longitudinal vertical planes, (iii) the spacers also extending in generally longitudinal vertical planes, the spacers cut from partition walls.

These and other objects and advantages of the invention, as well as the details of an illustrative embodiment, will be more fully understood from the following specification and drawings, in which:

DRAWING DESCRIPTION

DETAILED DESCRIPTION

Figure 2:
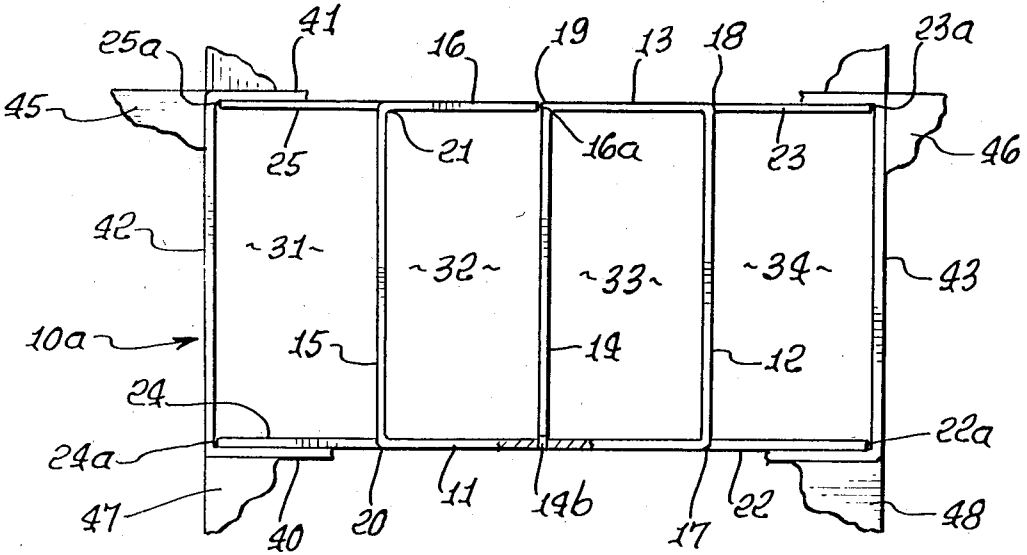
FIG. 2 is a top plan view of the FIG. 1 partition, in folded condition.

In the drawings, a box inner partition 10, typically of paperboard, is adapted to be folded and inserted in a paperboard (or other) outer box 10*a*, to form four cells, indicated at 31, 32, 33 and 34 in FIG. 2, within the outer box. The latter may for example extend the full depth of the box interior. In this regard, the folded partition itself may form cells 32 and 33, and cells 31 and 34 are then formed by the outer box and the partition, as will appear.

Figure 1:
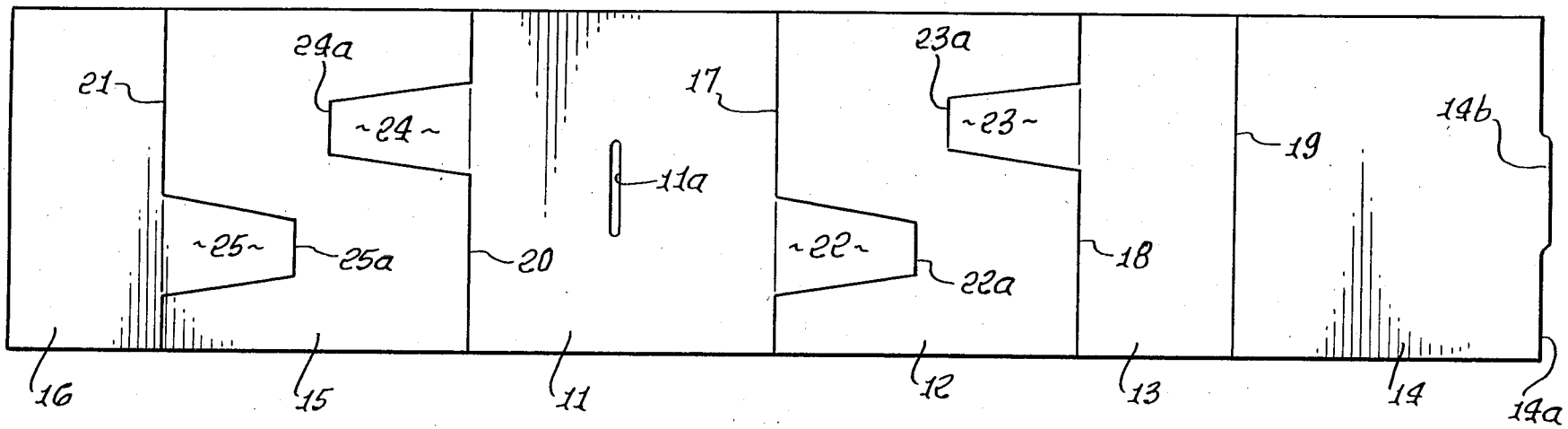
FIG. 1 is a front view of an unfolded partition embodying the invention.

Referring to FIG. 1, the partition in unfolded state is shown to include six walls or panels 11–16, in the sequence 16, 15, 11, 12, 13 and 14. The rectangular walls are interconnected by parallel folds, according to the following table:

| Interconnected walls | Fold |
|---|---|
| 11 and 12 | 17 |
| 12 and 13 | 18 |
| 13 and 14 | 19 |
| 15 and 11 | 20 |
| 16 and 15 | 21 |

Figure 3:
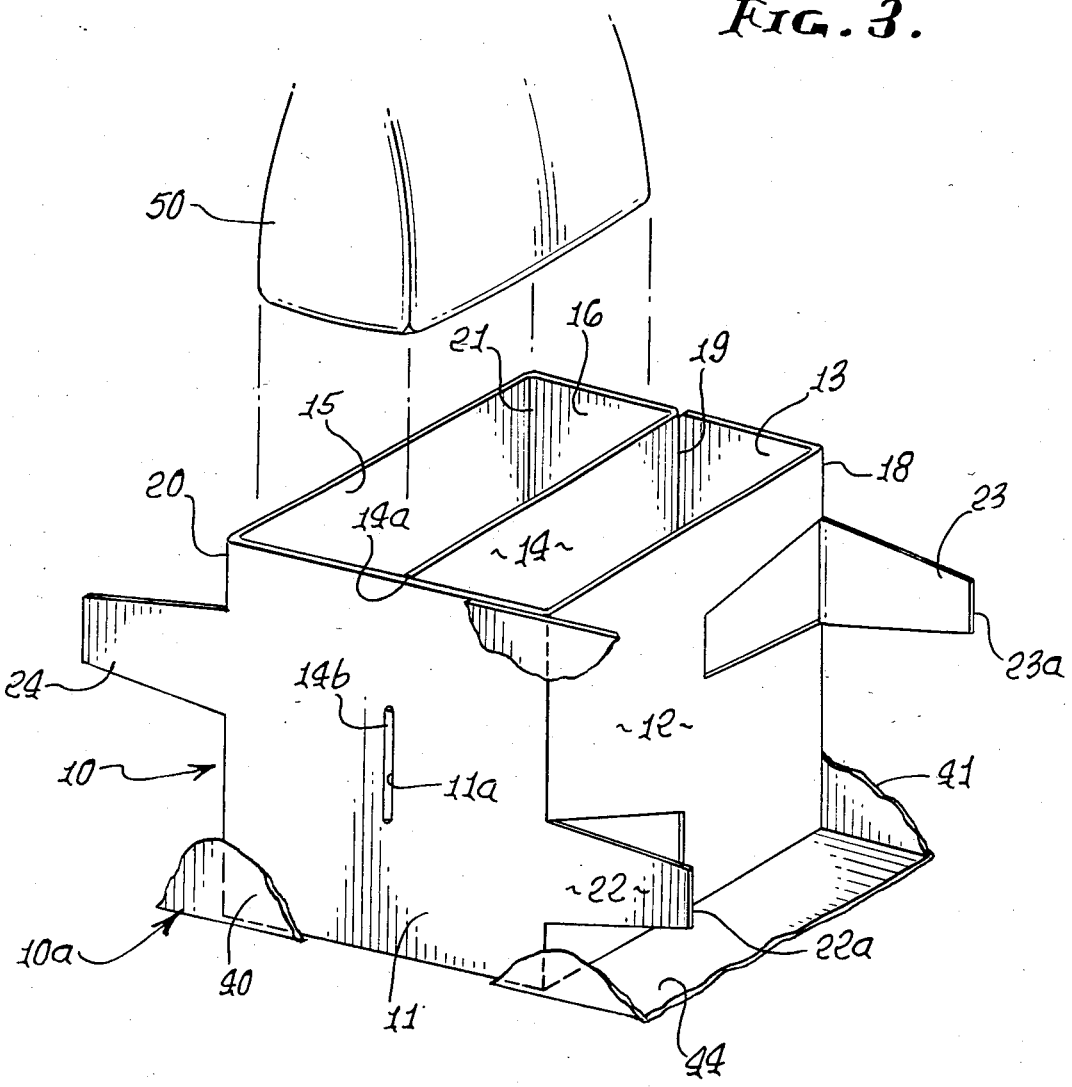
FIG. 3 is a perspective view of the Fig. partition in folded condition, and in an outer box, partly cut away.

Such walls may have vertical heights (see FIGS. 2 and 3) approximately equal to the height of the box sidewalls 40 and 41, and end walls 42 and 43, the latter connected by box bottom wall 44. Box top closure flaps appear as at 45–48.

In folded condition, and as inserted in the outer box, the partition 10 second, fourth and sixth walls 15, 12, and 14 are spaced apart in parallel relation, in lateral vertical planes perpendicularly between box walls 40 and 41, with sixth wall 14 located between the second and fourth walls 15 and 12. In this configuration, the first, third and fifth walls 16, 11 and 13 then extend in longitudinal vertical planes flatly adjacent box side walls, i.e. partition wall 11 lies adjacent the inner surface of box vertical side wall 40, and partition walls 13 and 16 lie flatly adjacent the inner surface of box vertical side wall 41. The vertical end or terminal 16*a* of wall 16 then extends adjacent fold 19; and main extent of vertical end or terminal 14*a* of wall 14 then extends adjacent the inside surface of wall 11, immediately of folds 17 and 20. A tongue 14*b* on wall 14 interfits a vertical groove 11*a* in wall 11, to form an interlock that keeps divider wall 14 in predetermined spaced relation to wall 12 and 15, to maintain the cells 32 and 33 in predetermined size relation.

In accordance with an important aspect of the invention, spacers are carried by the partition and project endwise beyond the partition end walls to cooperate with the box end walls 42 and 43, thereby to locate the partition in the box to define the two additional cells 31 and 34 between the partition end walls 15 and 12, and the box end walls 42 and 43. Note in this regard that representative spacers 22 and 24 are preferably in the same vertical plane (see FIGS. 2 and 3) as the plane of partition side wall 11; and that representative spacers 23 and 25 are preferably in the same vertical plane as the planes of partition side walls 13 and 16. This assures that the sizes of the lateral widths of the cells 31 and 34 will be the same as the widths of cells 32 ad 33, so that bottles or containers of the same lateral width, may be closely fitted in all the cells. Preferably, the cells are all of the same rectangular cross sectional size, as is clear from FIG. 2.

More specifically, the spacers may be cut from the partition walls, so that the partition walls and spacers are unitary, simplifying production and use of the partition. Thus, tapered partitions 22 and 23 are cut from wall 12, and tapered partitions 24 and 25 are cut from wall 15, the largest ends of partitions 22, 23, 24, and 25 respectively extending at the folds 17, 18, 20 and 21. Further, partitions 22 and 23 are at different elevations (see FIG. 3) and partitions 24 and 25 are at different elevation, assuring maintenance of "squaring" of the folded partition in the box. Note that the terminals 22*a* and 23*a* of spacers 22 and 23 project endwise adjacent the inner surface or box end wall 43 while spacers 22 and 23 extend flatly adjacent box side walls 40 and 41; and that terminals 24*a* and 25*a* of spacers 24 and 25 project endwise adjacent the inner surface of box end wall 42, while spacers 24 and 25 extend flatly adjacent box side walls 40 and 41.

Accordingly, a unitary partition is provided to be folded so as to quickly insert into a box, and form therewith four cells of predetermined, equal, and maintained size, the cell walls firmly located to support receptacles such as liquid fluid plastic bottles. Such bottle is indicated at 50 in FIG. 3.

The partition and box walls may typically consist of corrugated heavy paper.

I claim:

1. A box inner partition providing four cells at least, in the box interior formed by box opposite side walls and box opposite end walls, the partition having six walls and comprising (a) the partition folded to form opposite end walls, opposite side walls, and a divider wall, thereby providing two cells between the divider and the partition opposite end walls, (b) and spacers carried by the partition and projecting freely endwise beyond said partition end walls to cooperate with the box end walls thereby to locate the partition in the box to define two additional cells between the partition end walls and the box end walls, (c) said six walls interconnected by folds, to form a one-piece folded sheet and in first through sixth series sequence, said six walls, when the partition is folded, forming:

(i) the second, fourth and sixth walls extending in spaced apart parallel relation, in lateral vertical planes, the sixth wall located between the second and fourth walls, (ii) the first, third and fifth walls extending in longitudinal vertical planes, (iii) the spacers also extending in generally longitudinal vertical planes, (d) one pair of spacers cut from the second wall, and another pair of spacers cut from the fourth wall, (e) the two spacers of each pair extending at different elevation and generally longitudinally, the spacers of one pair projecting in one direction respectively from the folds between the third and second walls and between the first and second walls, and the spacers of the other pair projecting in the opposite direction, respectively from the folds between the fourth and fifth walls and between the third and fourth walls, the spacers being in the same planes as are defined by the partition opposite side walls.

2. The partition of claim 1 including said box receiving said partition, and in which said four cells are formed.

3. The partition of claim 1 wherein said partition consists of cardboard, or the like.

4. The partition of claim 1 including said box having walls and receiving the folded partition to provide said four cells, the spacers extending adjacent box walls.

5. The partition of claim 4 wherein the box walls include side walls and end walls, all spacers extend flatly adjacent box side walls, the spacers having terminals extending adjacent box end walls.

6. The partitions of claim 5 wherein two spacers project in a first cell and two spacers project in a fourth cell, the folded partition defining second and third cells located sequentially between said first and fourth cells.

7. The partition of claim 1 wherein the divider has one end that interlocks with one partition side wall.

8. The partition of claim 7 wherein the partition has an opposite end on another side wall that extends adjacent a fold that interconnects said divider with yet another side wall.

9. The combination that includes the partition of claim 1, a box receiving said partition, and filled receptacles received in said cells.

* * * * *